US008104247B2

(12) United States Patent
Hasse

(10) Patent No.: US 8,104,247 B2
(45) Date of Patent: Jan. 31, 2012

(54) DISPOSABLE ROOF COVERING

(76) Inventor: Margaret Henderson Hasse, Wyoming, OH (US)

( * ) Notice: Subject to any disclaimer, the term of this patent is extended or adjusted under 35 U.S.C. 154(b) by 2102 days.

(21) Appl. No.: 10/987,654

(22) Filed: Nov. 12, 2004

(65) Prior Publication Data

US 2005/0097828 A1 May 12, 2005

Related U.S. Application Data

(60) Provisional application No. 60/519,112, filed on Nov. 12, 2003.

(51) Int. Cl.
*E04B 1/00* (2006.01)
*E04G 21/00* (2006.01)
*E04G 23/00* (2006.01)

(52) U.S. Cl. ..... 52/746.11; 52/309.6; 52/745.13; 52/796.1; 428/71

(58) Field of Classification Search ..... 52/309.6, 52/745.13, 746.11, 749.1, 796.1; 428/71
See application file for complete search history.

(56) References Cited

U.S. PATENT DOCUMENTS 3,911,173 A 10/1975 Sprague, Jr.
3,929,135 A 12/1975 Thompson
4,151,240 A 4/1979 Lucas et al.
4,318,818 A 3/1982 Letton et al.
4,503,106 A * 3/1985 Cogliano ..... 428/40.3
4,573,986 A 3/1986 Minetola et al.
4,747,247 A 5/1988 Petersen, Jr. et al.
4,785,996 A 11/1988 Ziecker et al.
4,797,310 A * 1/1989 Barby et al. ..... 428/71
4,842,666 A 6/1989 Wernicz
4,866,905 A 9/1989 Bihy et al.
5,180,585 A 1/1993 Jacobson et al.
5,403,393 A 4/1995 Dubble
5,409,771 A 4/1995 Dahmen et al.
5,410,629 A 4/1995 Arroyo
5,466,489 A 11/1995 Stahl
5,614,283 A 3/1997 Potnis et al.
5,974,735 A * 11/1999 Behrens ..... 47/58.1 R
6,044,604 A * 4/2000 Clayton et al. ..... 52/309.9
6,045,622 A * 4/2000 Holt et al. ..... 134/6
6,047,519 A 4/2000 Bagn
6,056,231 A 5/2000 Neifer et al.
6,131,353 A 10/2000 Egan
6,191,057 B1 2/2001 Patel et al.
6,211,102 B1 4/2001 Jones et al.
6,221,464 B1 4/2001 Patel et al.
6,250,091 B1 6/2001 Jerome (Continued)

OTHER PUBLICATIONS

Fire-Blocking Gel, Precision Lift, Inc., http://www.precision.rotor.com/trialpgs/gel.shtml, Oct. 27, 2003.

(Continued)

*Primary Examiner* — Eileen D Lillis
*Assistant Examiner* — Chi Nguyen
(74) *Attorney, Agent, or Firm* — Hasse & Nesbitt LLC; Donald E. Hasse

(57) ABSTRACT

A disposable roof covering comprising a plastic substrate having a porous top surface, and a superabsorbent polymer located between the top surface and bottom surface of the substrate. The polymer absorbs water contacting the roof covering and allows it to evaporate over time to cool the roof structure and interior of the building. The invention provides a lightweight, low cost roof covering for cooling buildings. A method for cooling a roof structure by applying the disposable roof covering over the roof structure is also provided.

7 Claims, 2 Drawing Sheets

U.S. PATENT DOCUMENTS

| | | | | |
|---|---|---|---|---|
| 6,391,328 | B1 | 5/2002 | Levy | |
| 6,403,857 | B1 | 6/2002 | Gross et al. | |
| 6,420,626 | B1 | 7/2002 | Erspamer et al. | |
| 6,458,299 | B1 | 10/2002 | Wierer et al. | |
| 6,594,427 | B1 | 7/2003 | Dixon et al. | |
| 6,598,356 | B1 | 7/2003 | Sells | |
| 6,606,823 | B1 | 8/2003 | McDonough et al. | |
| 6,641,896 | B2 * | 11/2003 | Fensel et al. | 428/141 |
| 6,715,249 | B2 | 4/2004 | Rusek et al. | |
| 6,730,160 | B2 | 5/2004 | Barbosa | |
| 6,770,354 | B2 * | 8/2004 | Randall et al. | 428/219 |
| 7,014,726 | B2 * | 3/2006 | Whiting | 156/230 |
| 7,125,601 | B1 * | 10/2006 | Pinault et al. | 428/143 |
| 2003/0065296 | A1 | 4/2003 | Kaiser et al. | |

OTHER PUBLICATIONS

Technical Specifications, Barricade International Fire Protection Gel, http://www.barricadegel.com/technical.asp, Oct. 27, 2003.

Frequently Asked Questions, Barricade International Fire Protection Gel, http://www.barricadegel.com/faqs.asp, Oct. 27, 2003.

Questions About Thermogel, Thermo Technologies, LLC, http://www.thermogel.com/faqs.htm, Oct. 27, 2003.

* cited by examiner

DISPOSABLE ROOF COVERING

CROSS-REFERENCE TO RELATED APPLICATIONS

This application claims the benefit of co-pending U.S. Provisional Application No. 60/519,112, filed Nov. 12, 2003.

BACKGROUND OF THE INVENTION

The present invention relates to the field of roof coverings, in particular to a disposable roof covering comprising a plastic substrate having a porous top surface, and a superabsorbent polymer. The polymer absorbs water contacting the roof covering, e.g., from rainfall or applied using a sprinkler or garden hose, and slowly releases moisture to evaporation to cool the roof and building.

Many advances have been made in roofing and insulation technology to maintain a comfortable temperature inside buildings. These include developments in materials placed in the attic space, such as slurried or rolled insulation. There have been relatively few developments in materials applied to the external surface of roofs. As costs for energy increase, there is an increasing demand for low cost, energy efficient methods to cool buildings.

To address these concerns, materials have been placed over existing roofing materials for added thermal insulation. For example, a covering of vegetation on a roof structure provides a layer of insulation that helps keep the building interior cool in the summer and warm in the winter. Such methods typically use a layer of soil and a complex system of multi-layered materials to protect the underlying structure from damage. This type of construction can be expensive, and may require significant modifications to support and protect the roof structure. Because of the high costs and undesirable weight additions of such systems, many existing buildings cannot utilize these systems.

U.S. Pat. No. 6,606,823, McDonough et al., issued Aug. 19, 2003, discloses a modular roof covering made up of interlocking trays having a component or medium in the tray to absorb moisture and allow it to evaporate or otherwise dissipate over time. The modular roof covering may have vegetation growing in the tray. Other roof coverings merely have water absorption and dissipation capability, while other coverings have photovoltaic cells for the collection and use of solar energy.

U.S. patent application 2003/0065296, Kaiser et al., published Apr. 3, 2003, discloses an absorbent material containing at least about 30% superabsorbent polymer, a thermoplastic polymer binder resin, and from about 0.1% to 10% water. The method of making the absorbent material includes combining binder resin and absorbent polymer in a twin-screw extrusion mechanism, and compounding and extruding the composition through the exit openings. The quenched or non-quenched extrudate may be made in the form of a pellet, film, or fibrous strand.

Despite these advances in the art, there is a continuing need for a low cost, lightweight disposable roof covering for cooling buildings while at the same time reducing energy usage and environmental impact.

SUMMARY OF THE INVENTION

The present invention relates to a disposable roof covering for application over a roof structure, said roof covering comprising:

(a) a plastic substrate having a porous top surface for receiving water contacting the roof covering, and a bottom surface that contacts the roof structure; and (b) a superabsorbent polymer located between the top surface and bottom surface of the substrate, said polymer capable of absorbing an amount of water having a weight at least about 15 times its own weight.

In another embodiment, the invention relates to a method for cooling a roof structure, said method comprising:

(a) providing a disposable roof covering for application over a roof structure, said roof covering comprising:

i) a plastic substrate having a porous top surface for receiving water contacting the roof covering, and a bottom surface that contacts the roof structure; and ii) a superabsorbent polymer located between the top surface and bottom surface of the substrate, said polymer capable of absorbing an amount of water having a weight at least about 15 times its own weight; and (b) applying the disposable roof covering over the roof structure.

DETAILED DESCRIPTION OF THE INVENTION

Figure 1:
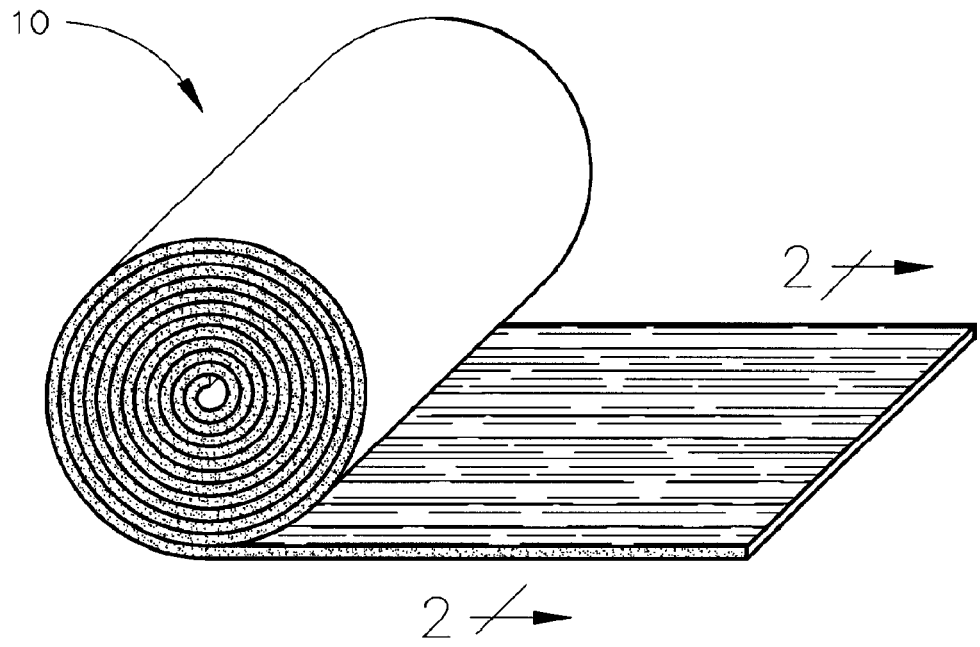
FIG. 1 is a perspective view of a disposable roof covering of the present invention in the form of a roll of batting that can be applied over a roof structure.

The disposable roof covering of the invention comprises a plastic substrate having a porous top surface for receiving water contacting the roof covering, and a bottom surface that contacts the roof structure. The form of the substrate may vary from one embodiment to another depending on the design requirement for the particular application. The substrate may comprise one or more layers of plastic material. The top surface of the substrate is porous so that water contacting the top surface flows through and contacts the superabsorbent polymer located between the top surface and bottom surface of the substrate. Excess water not absorbed by the superabsorbent polymer, the substrate or other materials added to the roof covering runs off the roof. The substrate and other added materials typically do not absorb any significant amount of water compared to the superabsorbent polymer. For example, they may absorb less than about 20%, typically less than about 10%, more typically less than about 5%, by weight of the amount of water absorbed by the superabsorbent polymer. In one embodiment, the substrate and other added materials absorb less than about 50%, typically less than about 20%, more typically less than about 10%, of their own weight. The disposable roof covering typically does not comprise absorbent paper or unmodified cellulose material that could degrade before the roof covering is intended for removal. Such paper or cellulose material could also promote undesirable fungal or bacterial growth in the roof covering or on its surfaces.

Materials that can be used to form the plastic substrate include any suitable synthetic material that can be shaped and substantially retains its shape after manufacture, including polyesters, polsyamides and polyolefins. The substrate is typically made of a polymer that has at least one hydrophobic monomer, e.g., a polyolefin material, such as disclosed in U.S. patent application 2003/0065296, incorporated herein by reference. Polyolefins useful herein include materials such as polyethylene, polypropylene, ethylene vinyl acetate copolymer and the like, the homopolymers, copolymers, terpolymers, etc, thereof, and blends and modifications thereof. Polypropylene substrates useful herein include homopolymers, copolymers, such as for example block, graft, random, and alternating copolymers, terpolymers, etc., of propylene, and blends and modifications thereof. The substrate can be manufactured by any known method, and the method of manufacture is generally selected for the material used.

The substrate typically comprises at least one porous web that is a carrier for the superabsorbent polymer. The porous web is typically made of a nonwoven material. In one embodiment, the web is a polypropylene spun bond material or spunbond/meltblown material, such as available from BBA Nonwovens, Simpsonville, S.C. Alternatively, the substrate comprises an airlaid synthetic fiber web, such as disclosed in U.S. Pat. Nos. 6,458,299; 6,420,626; and 6,403,857; all incorporated herein by reference. In another embodiment, the substrate comprises a perforated or apertured plastic film, such as available from Tredegar Film Products, Terre Haute, Ind. Suitable films are disclosed in, for example, U.S. Pat. Nos. 3,929,135; 4,151,240; and 5,614,283; all incorporated herein by reference. The substrate may comprise two or more porous webs, with the superabsorbent polymer distributed among or between the webs.

In another embodiment, the substrate comprises a molded or extruded plastic material, such as the thermoplastic polymer binder resin disclosed in the above cited U.S. patent application 2003/0065296. The molded or extruded plastic material typically is used as a bottom layer of the substrate that contacts the roof. For example, it may be an extruded water-impermeable polyethylene film. The molded or extruded plastic material may be perforated in places to allow water and/or air to flow through it. It may also be rippled or corrugated to allow water and/or air to flow under it.

The disposable roof covering further comprises a superabsorbent polymer located between the top surface and bottom surface of the substrate. The polymer is typically used at a level of from about 30% to about 95%, more typically from about 40% to about 90%, e.g., from about 50% to about 85%, by weight of the disposable roof covering, on a dry basis. The superabsorbent polymer is capable of absorbing an amount of water having a weight at least about 15 times its own weight. The polymer typically is capable of absorbing an amount of water having a weight at least about 20 times its weight, and more typically at least about 25 times its own weight. The superabsorbent polymer is selected to capture, hold and slowly release moisture through evaporation, thereby cooling the roof and the building. The polymer may be applied to the substrate in any suitable form, but typically is provided as a powder, granular, flake or fibrous material.

Superabsorbent polymers useful herein are disclosed in U.S. patent application 2003/0065296, incorporated herein by reference. Such polymers may be obtained by polymerizing at least about 10%, typically at least about 25%, and more typically from about 55% to about 99.9%, by weight, of monomers having olefinically-unsaturated groups, such as acrylonitrile groups, anhydride groups, carboxylic acid groups, or sulfonic acid groups. Such carboxylic acid groups include, but are not limited to, acrylic acids and methacrylic acids. An example of a sulfonic acid group is 2-acrylamido-2-methylpropane sulfonic acid. The groups are typically present as salts, such as sodium, potassium, or ammonium salts, e.g., the sodium acrylate salt of acrylic acid.

The acid groups are typically neutralized to at least about 25 mol %, more typically to at least about 50 mol %. The superabsorbent polymer is often formed from cross-linked acrylic acid or methacrylic acid, which has been neutralized to from about 50 to about 80 mol %. Suitable neutralizing agents are hydroxides and/or carbonates of alkaline earth metals and/or alkali metals, for example Na, K, Li, Be, Mg, Fe, Co, Ni, and the like. In one embodiment, the superabsorbent polymer is sodium polyacrylate.

Additional useful monomers for making the superabsorbent polymer include ethers, imides, amides (such as acrylamide, methacrylamide, and dimethyl aminopropyl acrylamide), maleic acid, maleic anhydride, vinyl chloride, vinyl alcohol, styrene, esters (such as hydroxyethyl acrylate, hydroxypropyl acrylate, hydroxypropyl methacrylate, and dimethyl-aminoalkyl-methacrylate), and acrylamidopropyl trimethylammonium chloride.

Suitable network cross-linking agents useful in making the superabsorbent polymer are those which have at least two ethylenically unsaturated double bonds, those which have one ethylenically unsaturated double bond and one functional group reactive toward acid groups, and those which are multifunctional, i.e., have several functional groups reactive toward acid groups. Suitable network cross-linking agents include acrylate and methacrylate of polyols (such as butanediol diacrylate, hexanediol dimethacrylate, polyglycol diacrylate, trimethylpropane triacrylate, allyloxy polyethylene glycol diacrylate, and ethoxylated trimethylolpropane triacrylate), allyl acrylate, diallyl acrylamide, triallyl amine, diallyl ether, methylenebisacrylamide, glycerol dimethacrylate, N-methylol methacrylamide, and N-methylolacrylamide. Suitable network cross-linking agents that are multi-functional include alcohols, amines, and epoxides, such as glycol, propylene glycol, glycerol, ethylene diamine, hexamethylene diamine, glycerol polyglycidal ether, and resorcinol diglycidal ether.

U.S. Pat. No. 5,409,771 discloses coating superabsorbent polymer particles with an alkylene carbonate followed by heating to effect surface cross-linking. The superabsorbent polymer useful in the present invention may be surface cross-linked. In order to coat the superabsorbent polymer particles with a surface cross-linking agent (such as an alkylene carbonate, a diol, a diamine, or a diepoxide), the superabsorbent polymer particles may be mixed with an aqueous-alcoholic solution of the surface cross-linking agent. Suitable alcohols are methanol, ethanol, butanol, or butyl glycol, as well as mixtures of these alcohols. The solvent is often water, which typically is used in an amount of 0.3% to 5.0% by weight, relative to the particulate superabsorbent polymer. In some instances, the surface cross-linking agent is dissolved in water, without any alcohol. It is also possible to apply the surface cross-linking agent from a powder mixture, for example, with an inorganic carrier material, such as $SiO_2$.

The following are suitable as surface cross-linking agents. Alkylene carbonates include, for example, 1,3-dioxolan-2-one, 4-methyl-1,3-dioxolan-2-one, 4,5-dimethyl-1,3-dioxolan-2-one, 4,4-dimethyl-1,3-dioxolan-2-one, 4-ethyl-1,3-dioxolan-2-one, 4-hydroxyethyl-1,3-dioxolan-2-one, 1,3-dioxan-2-one, 4-methyl-1,3-dioxan-2-one, 4,6-dimethyl-1,3-dioxan-2-one, 1,3-dioxepan-2-one, and combinations thereof. A diol is 1,4-butanediol diglycidyl ether. A diamine is 1,5-diaminopentane. A diepoxide is 1,3-butadiene diepoxide.

To achieve the desired surface cross-linking properties, the surface cross-linking agent should be distributed evenly on the superabsorbent polymer. For this purpose, mixing is effected in suitable mixers, such as fluidized bed mixers, paddle mixers, milling rolls, or twin-worm-mixers.

The superabsorbent polymer typically is a polyacrylate or polyacrylamide polymer or copolymer. In one embodiment, the polymer comprises from about 95% to about 98% crossed linked sodium polyacrylate copolymer and from about 2% to about 5% moisture, and is commercially available from Dow Chemical, Midland, Mich. Other superabsorbent polymers useful herein are available from Stockhausen (Greensboro, N.C.) and Chemdal (Arlington Heights, Ill.). The superabsorbent polymer typically has a particle size ranging from about 100 to about 1000 microns, more typically from about 200 to about 800 microns. Small particle size (e.g., less than 200 microns) polymers may be desired in the present invention because of their faster water absorption rates.

The superabsorbent polymer may be attached to the substrate using a water-insoluble adhesive, e.g., a hot-melt adhesive such as Century 5227 sold by Century Adhesives, Inc. of Columbus, Ohio; HL1258 adhesive sold by the H.B. Fuller Company of St. Paul, Minn.; or Findley Adhesive H2031 available from the Findley Adhesive Company of Elmgrove, Wis. The adhesive may be applied to the substrate as a uniform continuous layer of adhesive, a patterned layer of adhesive, or an array of separate lines, spirals, or spots of adhesive. For example, the adhesive may be applied as an open pattern network of filaments of adhesive such as disclosed in U.S. Pat. No. 4,573,986, or as several lines of adhesive filaments swirled into a spiral pattern such as shown in U.S. Pat. No. 3,911,173, U.S. Pat. No. 4,785,996, and U.S. Pat. No. 4,842,666, all incorporated herein by reference. The adhesive can be applied by a meltblown or spray process. In one embodiment, the adhesive is sprayed on the substrate and powdered superabsorbent polymer is applied over the adhesive. A porous plastic top layer is typically then applied over the superabsorbent polymer. The top layer helps protect the superabsorbent polymer from UV exposure, and also minimizes direct contact between the polymer, which may become sticky when wet, and leaves and other debris that may fall from nearby trees. The adhesive also typically bonds this top layer to the bottom layer of the substrate. This helps to keep the superabsorbent polymer relatively uniformly distributed along the length and width of the disposable roof covering. In an alternative embodiment, two or more layers of the substrate may be joined together by pressure-sensitive and/or hot-melt adhesive properties of the layer materials. Heat bonds, pressure bonds, ultrasonic bonds, dynamic mechanical bonds, or any other suitable attachment means, or combinations thereof, may be used to attach two or more layers of the substrate together. In another embodiment, the superabsorbent polymer is in the form of a fibrous material that can be entangled in the substrate or between layers of the substrate, particularly a web substrate. In this embodiment, the top and bottom surfaces of the substrate, or layers thereof, typically are intermittently bonded together, e.g., about every 0.1 $m^2$, to keep the superabsorbent polymer substantially uniformly distributed throughout the roof covering.

The disposable roof covering of the invention is typically attached to the roof at one or more points to hold it securely in place. For example, the roof covering may be attached by using clips or hooks to fasten the roof covering to the roof at its apex and edges, or other convenient points of attachment. Sections of the roof covering may be connected to each other to cover a large area on a roof. These sections may be preassembled and then installed on the roof. Additionally, the roof covering may be ballasted or weighted down without being physically connected to the roof surface.

Periodic rainfall or high humidity may be relied upon to wet the disposable roof covering and superabsorbent polymer. Optionally, a sprinkler system may be used to provide water to wet the roof covering. This is particularly useful in hot and arid climates, where it may be desirable to wet the roof covering several times a day. Any standard sprinkler or irrigation system can be used to wet the roof covering. For example, sprinkler heads connected to water lines or hoses may be installed on the roof, or one or more perforated water hoses may be placed on the roof, to periodically wet the roof covering. A timer may be used so that the water is automatically released at a certain time of day, or when the roof heats to a selected temperature, and/or when the water held by the superabsorbent polymer reaches a minimum level. Alternatively, the roof covering may be manually sprayed with water using a garden hose on hot dry days.

In another embodiment, the roof covering comprises a top layer or material selected to accommodate any aesthetic requirements. For example, the roof covering may comprise a material to match the color and/or texture of the roof so that it blends in without changing the appearance of the building. Alternatively, the roof covering may comprise a material to change the color or appearance of the roof to provide a desired effect. The roof covering, e.g., the substrate, may comprise one or more colorants, pigments, or other materials to make the roof covering blend in or contrast with the rest of the building or surrounding environment, or to make the roof covering appear to be made of a desired material, e.g., slate, shingles, or tile. Suitable pigments include rutile and anatase titanium dioxide, calcite, limestone, mica, talc, cellulose fiber or powder, diatomaceous earth, barytes, alumina, slate flour, calcium silicate, clay, colloidal silica, calcium carbonate, magnesium carbonate, magnesium silicate, zinc oxide, and the like. For armed forces serving in hot and arid climates, a material may be added to the roof covering to camouflage the building from viewing at higher elevations. The colorants, pigments and other materials that may be added to or attached to the roof covering should not significantly reduce the water-absorbing capacity of the superabsorbent polymer. Alternatively, colorants or pigments may be added to the roof covering along with or as part of the superabsorbent polymer material so long as they do not significantly reduce its water absorbing capacity.

In one embodiment, the disposable roof covering further comprises an antimicrobial or antifungal agent, or mixtures thereof. U.S. Pat. No. 5,180,585, Jacobson et al., describes a suitable material comprising inorganic core particles coated with a metal or metal compound having antimicrobial properties. Other materials include the AMICAL and DOWICIL antimicrobials from Dow Chemical Company, Midland, Mich. The antimicrobial or antifungal agent may be admixed with or included as part of the superabsorbent polymer, or it may be added to or included in the substrate.

In another embodiment, the disposable roof covering comprises a minor amount, e.g., up to about 1% by weight, of a surfactant to increase wettability. The surfactant can be selected from the various nonionic, anionic, cationic, zwitterionic and amphoteric surfactants, such as those described in U.S. Pat. No. 4,318,818, Letton et al., incorporated herein by reference.

The disposable roof covering of the present invention may also comprise minor amounts (e.g., less than about 5% by weight) of other materials or ingredients such as diluents, adjuvants, dyes, emulsifiers, film-forming agents, compatibility agents, natural or synthetic polymers, hydrocolloids, ultraviolet absorbers, suspending agents, penetrants, dispersing agents, stabilizing agents, sticking agents, and the like, or combinations thereof.

The invention also relates to a method for cooling a roof structure, said method comprising providing a disposable roof covering as described above, and applying the roof covering over the roof structure. Cooling of the roof structure and the building occurs when water absorbed by the superabsorbent polymer in the roof covering evaporates over time. Water may be applied to the roof covering as rainfall or by spraying or sprinkling, e.g., by using a garden hose.

The present invention is now explained in further detail with reference to the accompanying drawings, which do not limit the scope of the invention in any way.

FIG. 1 shows a disposable roof covering 10 according to one embodiment of the present invention. The roof covering can be made from any suitable material, considering manufacturing limitations and cost restraints, and can be made in any practical size or shape as design parameters permit. In the embodiment shown in FIG. 1, roof covering 10 is in the form of a roll of batting that allows for easy transportation and installation on the roof of a building. For example, the roll of batting may have a width of from about 0.5 to about 1 meter and a diameter (when rolled up) of from about 0.3 to about 1 meter. Alternatively, the roof covering may be provided in the form of smaller shingles or larger mats that cover sections of the roof. The roof covering 10 is typically mechanically connected to the roof and/or other sections of the roof covering. The mechanical connection can be made by any known or commonly used method, such as by using known mechanical fasteners (e.g., clips, hooks, nails, screws, rivets, adhesive, etc., or a combination of any of these). However, since the roof covering typically is removed from the roof at the end of the cooling season, when cooling is no longer desired, or when the superabsorbent polymer loses its water absorbing capacity, the method of attachment should be selected to simplify the removal process.

Figure 2:
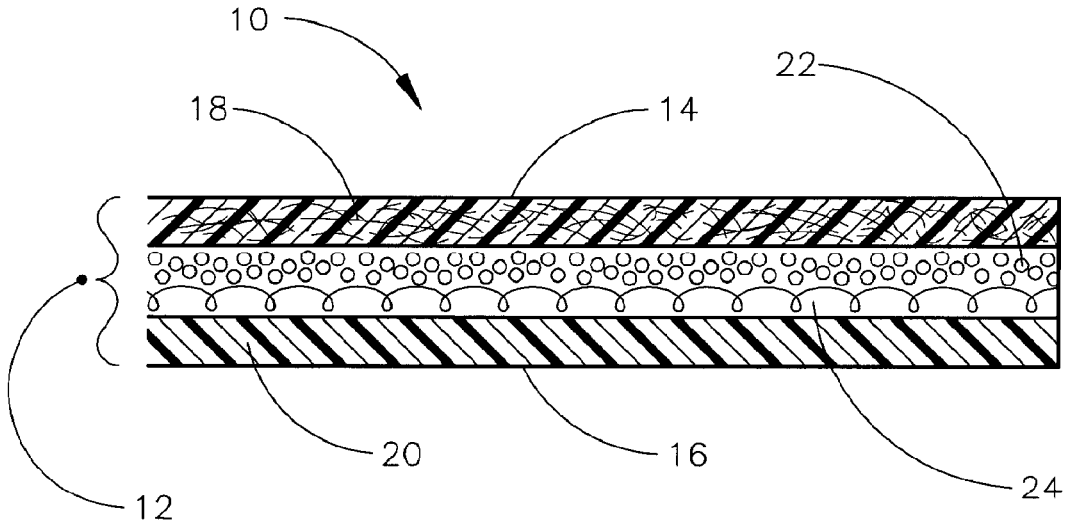
FIG. 2 is a cross-section view of the disposable roof covering of FIG. 1, taken along lines 2-2.

FIG. 2 shows a cross-section of a roof covering 10 according to one embodiment of the present invention. Roof covering 10 comprises a plastic substrate 12 having a porous top surface 14 for receiving water contacting the roof covering, and a bottom surface 16 that contacts the roof structure (not shown). In one embodiment, substrate 12 comprises an upper layer 18 made of a spun bond polypropylene web and a lower layer 20 made of a low-density polyethylene film.

Roof covering 10 also comprises a superabsorbent polymer 22 substantially uniformly distributed between layers 18 and 20. Polymer 22 is a powder or granular material capable of absorbing an amount of water having a weight at least about 15 times its weight, and typically at least about 20 times its own weight. The polymer comprises about 95% to about 98% crossed linked sodium polyacrylate copolymer and about 2% to about 5% moisture, and is commercially available from Dow Chemical, Midland, Mich. Polymer 22 is attached to layer 20 using a hot-melt adhesive 24, such as HL1258 sold by H.B. Fuller Company of St. Paul, Minn. The thickness of roof covering 10 (when dry) may vary depending on the various application and design criteria, but typically is from about 1 mm to about 15 mm, more typically from about 2 mm to about 10 mm (e.g., from about 3 mm to about 8 mm). Upper layer 18 and lower layer 20 each typically have a thickness of from about 0.05 to about 1 mm, more typically from about 0.1 to about 0.5 mm. The dry thickness of the roof covering typically ranges from about 1 to about 10 mm, more typically from about 2 to about 6 mm. In one embodiment, the dry thickness of roof covering 10 is about 2 mm, and its saturated thickness is about 10 mm. A thicker web may comprise more superabsorbent material and thus retain more water, increasing weight loads.

Figure 3:
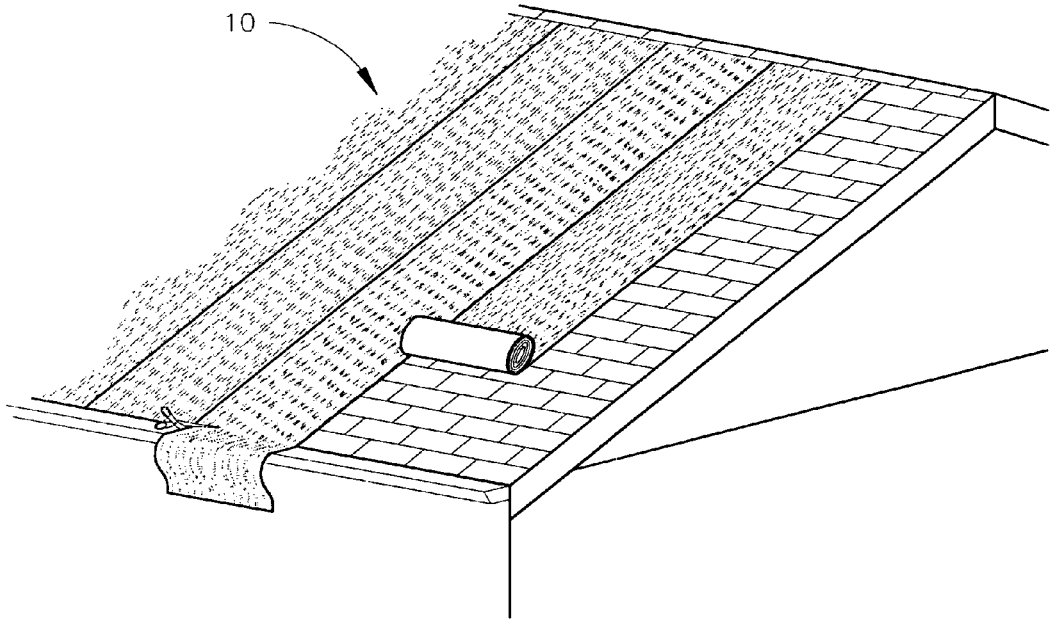
FIG. 3 is a perspective view of the roof covering of FIG. 1 placed on a roof structure.

FIG. 3 shows an installation of the roof covering 10 of FIG. 1 on a roof structure. During installation, an installer may clip or hook the start of the roll of batting shown in FIG. 1 to the apex of the roof (e.g., to the cap, shingles, or roof support structure) and roll the batting to the bottom edge of the roof. The batting may then be cut with a knife or scissors and affixed to the bottom edge of the roof. Alternatively, the batting may be perforated at regular intervals and torn at a convenient point to fit the roof or to simplify the installation process. In this embodiment, the perforations are typically made in areas where no superabsorbent polymer is located. The installation process can be repeated until the entire roof or the desired section thereof is covered with the batting. The roof covering may be secured to the roof at various points to prevent it from coming loose under adverse weather conditions, using any of the previously discussed methods.

Water absorbed by the superabsorbent polymer in roof covering 10 during rainfall or when wet using a garden hose slowly evaporates over time to provide roof and building cooling. Water not absorbed by the superabsorbent polymer drains off or out of the roof covering and off the roof, limiting the weight on the roof and preventing saturation damage to the roof structure. At the end of the cooling season, the roof covering can be removed from the roof structure and disposed of in a suitable manner. The invention thus provides a low cost, lightweight disposable roof covering for cooling buildings while at the same time reducing energy usage and environmental impact.

Although various embodiments of the invention have been described and exemplified, it will be understood that the scope of the invention is not limited to that description. Changes and modifications will occur to those of ordinary skill in the art and they can be made without departing from the spirit and scope of the invention. The invention is considered to include the methods of accomplishing the results described herein as well as structures designed to accomplish them.

What is claimed is:

1. A method for cooling a roof structure, said method comprising:

(a) providing a disposable roof covering for application over a roof structure, said roof covering comprising:

i) a plastic substrate having a porous top surface for receiving water contacting the roof covering, and a bottom surface; and ii) a superabsorbent polymer located between the top surface and bottom surface of the substrate, said polymer capable of absorbing an amount of water having a weight at least about 15 times its own weight; and (b) applying the disposable roof covering over the roof structure.

2. The method of claim 1 further comprising applying water to the disposable roof covering.

3. The method of claim 1 wherein the substrate comprises at least one porous web.

4. The method of claim 1 wherein the superabsorbent polymer is capable of absorbing an amount of water having a weight at least about 20 times its own weight.

5. The method of claim 4 wherein the superabsorbent polymer is a polyacrylate or polyacrylamide material.

6. The method of claim 5 wherein a water-insoluble adhesive attaches the superabsorbent polymer to the substrate.

7. The method of claim 6 wherein the substrate comprises a polypropylene spun bond web.

* * * * *